US009422800B2

(12) United States Patent
Le Ravalec

(10) Patent No.: US 9,422,800 B2
(45) Date of Patent: Aug. 23, 2016

(54) METHOD OF DEVELOPING A PETROLEUM RESERVOIR FROM A TECHNIQUE FOR SELECTING THE POSITIONS OF THE WELLS TO BE DRILLED

(75) Inventor: Mickaele Le Ravalec, Rueil-Malmaison (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 804 days.

(21) Appl. No.: 13/597,613

(22) Filed: Aug. 29, 2012

(65) Prior Publication Data

US 2013/0020131 A1 Jan. 24, 2013

(30) Foreign Application Priority Data

Jun. 9, 2011 (FR) ..... 11 02701

(51) Int. Cl.
*G06G 7/48* (2006.01)
*E21B 43/30* (2006.01)

(52) U.S. Cl.
CPC ..... *E21B 43/30* (2013.01)

(58) Field of Classification Search
CPC ..... E21B 49/00
USPC ..... 703/10; 702/6
See application file for complete search history.

(56) References Cited

U.S. PATENT DOCUMENTS 5,757,663 A 5/1998 Lo et al.
2007/0061117 A1* 3/2007 Landis et al. ..... 703/10
2009/0194274 A1* 8/2009 Del Castillo et al. ... 166/250.01
2010/0179797 A1* 7/2010 Cullick ..... E21B 43/30 703/10
2011/0024126 A1* 2/2011 Brouwer ..... E21B 43/30 166/369
2012/0143577 A1* 6/2012 Szyndel ..... E21B 49/00 703/10

FOREIGN PATENT DOCUMENTS

WO WO 01/23829 A2 4/2001

OTHER PUBLICATIONS

Cavalcante, J.: "Methodology for Quality Map Generation to Assist with the Selection and Refinement of Production Strategies", SPE 101940, Oct. 12, 2005, pp. 1-10, XP002676803.
Da Cruz, P.S. et al: "The Quality Map: A Tool for Reservoir Uncertainty Quantification and Decision Making", SPE ATCE, SPE 56578, Houston, TX, USA, 1999 (11 pages).
(Continued)

*Primary Examiner* — Eunhee Kim
(74) *Attorney, Agent, or Firm* — Fitch, Eve, Tabin & Flannery LLP

(57) ABSTRACT

The invention is a method of developing a petroleum reservoir employing a technique for selection of the position of the wells to be drilled. A production indicator map is utilized comprising a set of cells each associated with a production indicator defining impact on fluid production of addition of a well in this cell. The production indicator map is constructed by selecting cells from among the set of cells of the map; determining production indicators in the selected cells; and interpolating the production indicators on the set of cells of the map, by an interpolation model accounting for a distance between the cell to be interpolated and the closest well to the cell to be interpolated. The position of the well to be drilled is defined by the cell where the production indicator is a maximum.

23 Claims, 4 Drawing Sheets

(56) References Cited

OTHER PUBLICATIONS

Contini-Loureiro, A, et al: "Optimized Well Location by Combination of Multiple Realization Approach and Quality Map Methods", SPE 95413, SPE ATCE, Dallas, TX, USA, Oct. 9-12, 2005 (10 pges).

Cheng, Y. et al: A Practical Approach for Optimization of Infill Well Placement in Tight Gas Reservoirs, Journal of Natural Gas Science and Engineering 1, pgs. 165-176, 2005.

* cited by examiner

Figure 3.1
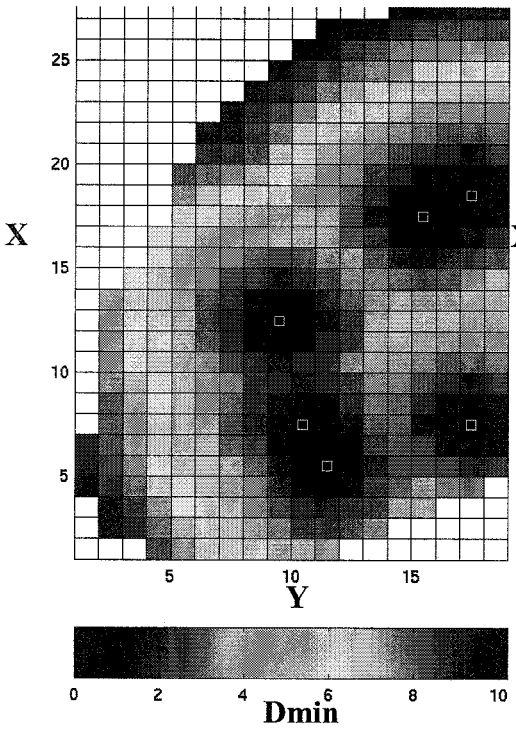
Figure 3.2
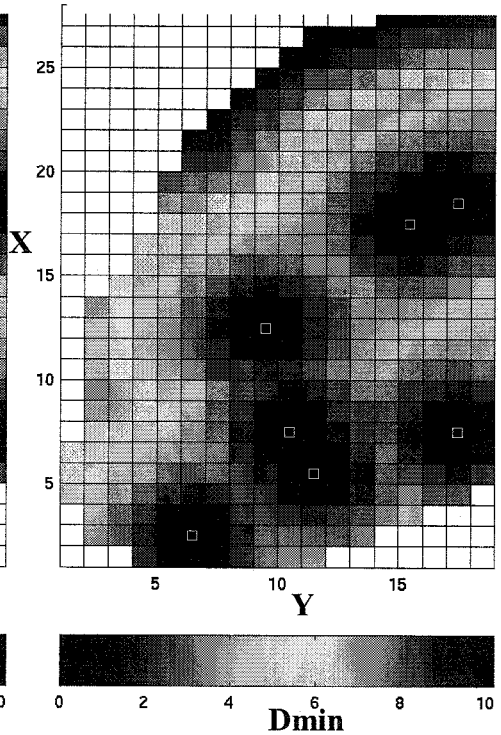
Figure 3.3
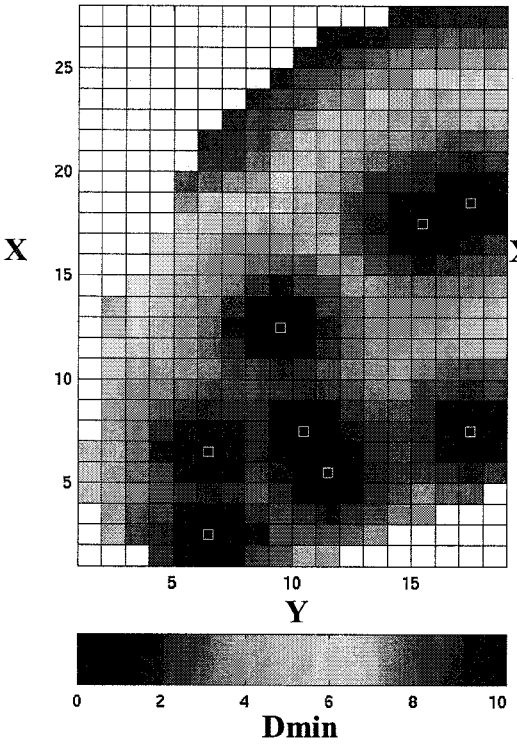
Figure 3.4
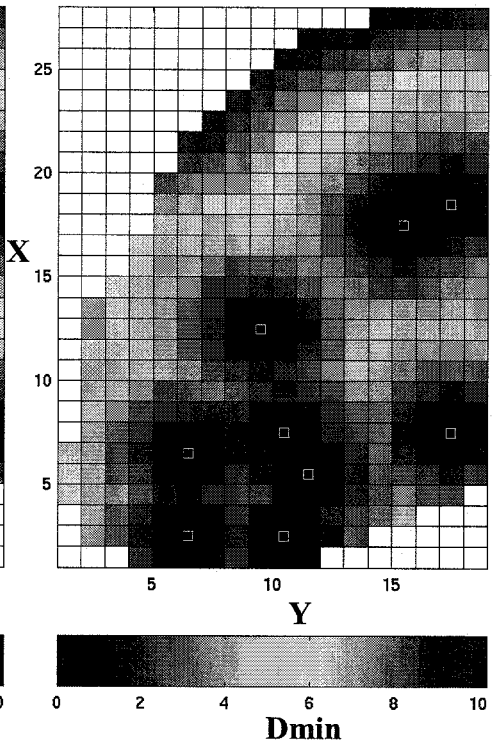

Figure 3.5
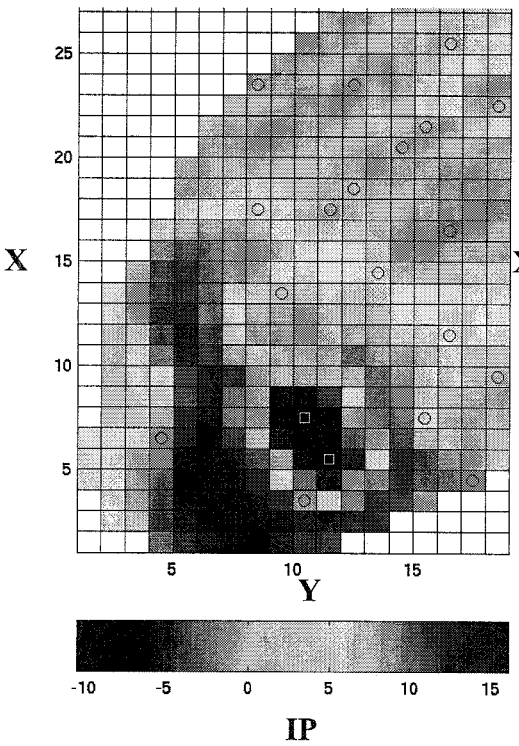
Figure 3.6
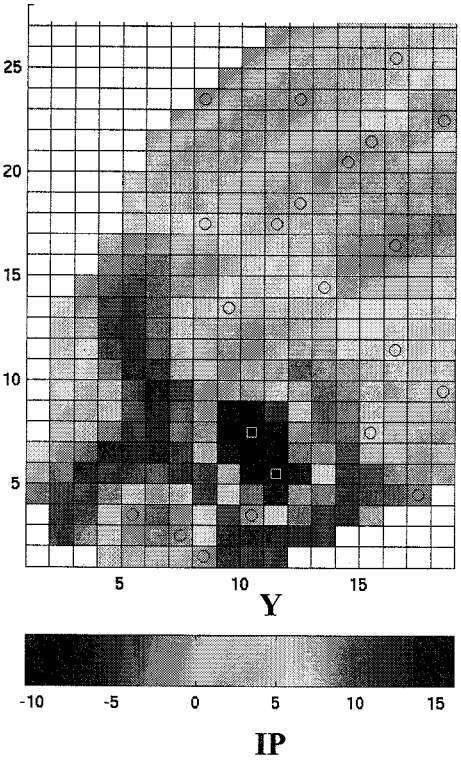
Figure 3.7
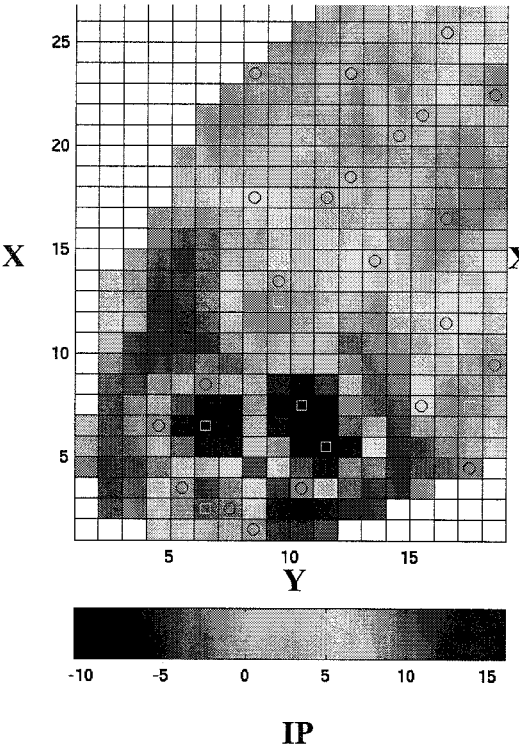
Figure 3.8
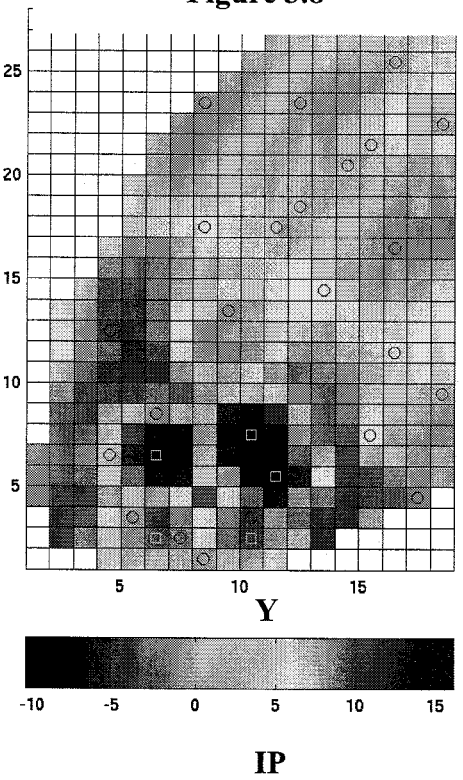

Figure 3.9
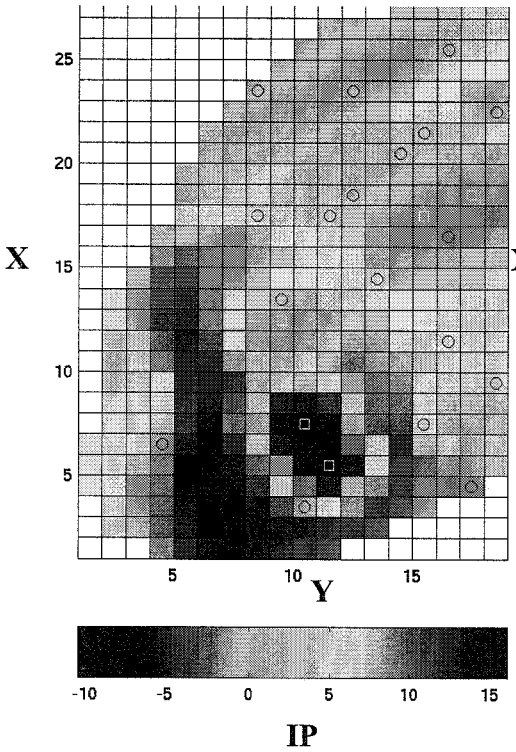
Figure 3.10
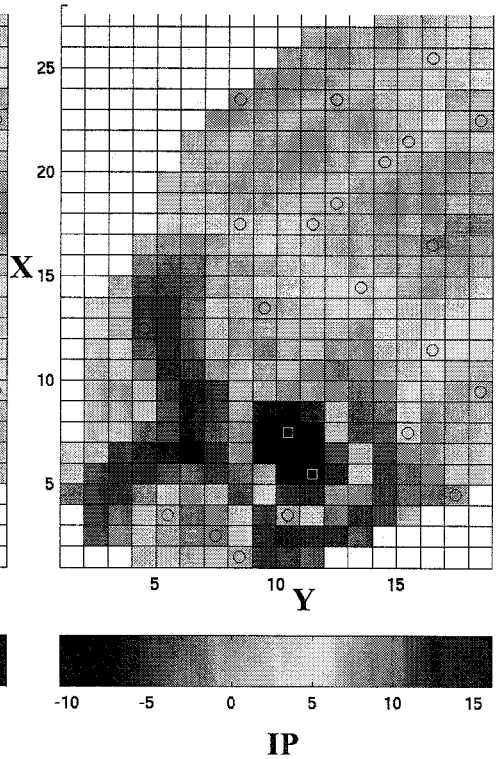
Figure 3.11
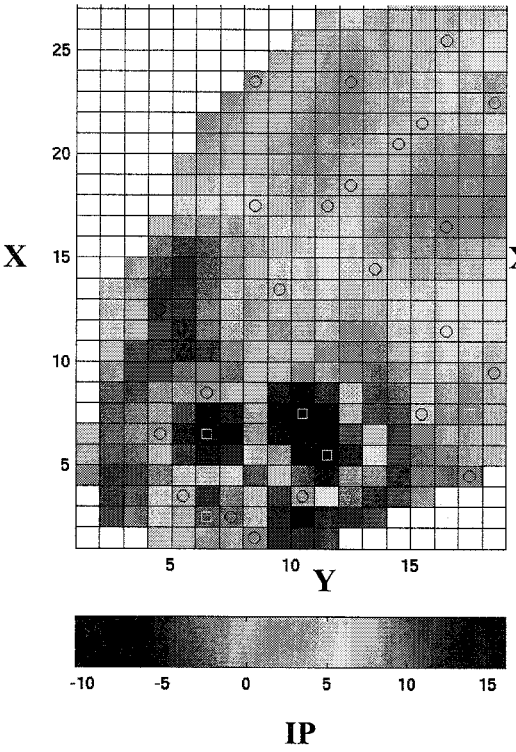
Figure 3.12
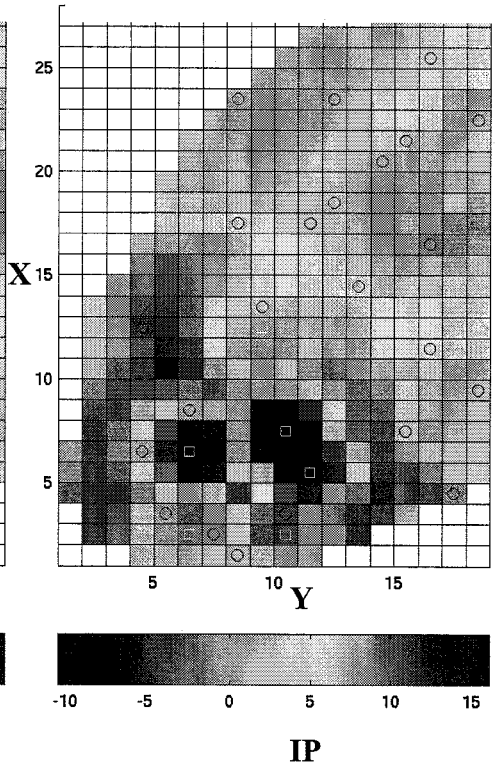

METHOD OF DEVELOPING A PETROLEUM RESERVOIR FROM A TECHNIQUE FOR SELECTING THE POSITIONS OF THE WELLS TO BE DRILLED

CROSS REFERENCE TO RELATED APPLICATION

Reference is made to French Patent Application Serial No. 11/02.701, filed on Sep. 6, 2011, which application is incorporated herein by reference in its entirety.

BACKGROUND OF THE INVENTION

1. Field of the Invention

The present invention relates to the petroleum industry, and more particularly to the development of underground reservoirs such as petroleum reservoirs or gas storage sites. In particular, the invention allows efficient planning of the development of a reservoir by selecting positions where new wells are to be drilled for which production potential will be a maximum.

2. Description of the Prior Art

Optimization and development of petroleum reservoirs is based on the most accurate possible description of the structure, the petrophysical properties, the fluid properties, etc., of the reservoir under study. A tool accounting for these aspects in an approximate way is a reservoir model. A reservoir model is a model of the subsoil which is representative of both its structure and its behavior. Generally, this type of model is represented in a computer and is then referred to as a "numerical model". A reservoir model comprises a mesh or grid, generally three-dimensional, associated with one or more petrophysical property maps (porosity, permeability, saturation, etc.). The association assigns values of these petrophysical properties to each cell of the grid.

In order to be considered reliable, the reservoir model must agree with as much data collected in the field. The data are well-log data measured along the wells, measurements performed on rock samples taken in the wells, data determined from seismic acquisition surveys, production data such as oil and water flow rates, pressure data, etc. These data are not sufficient to precisely characterize the petrophysical property values to be assigned to the cells of the model. This is why a stochastic formalism is generally used. The petrophysical properties are considered as realizations of random functions. A possible image of the reservoir, that is, a model is then generated from geostatistical simulation techniques. Solving flow equations for this model provides production responses. These responses are then compared with the production data measured in the wells. The difference between the simulated responses and the data acquired in the field has to be minimized to increase predictivity of the reservoir model. This stage involves a calibration or optimization procedure, which in general requires substantial computation time because of its iterative process requiring a flow simulation per iteration. A single flow simulation often requires several hours of computation time.

When a model meeting the data measured in the field is finally obtained, it is used to predict the fluid displacements in the reservoir and to plan the future development of the field. For example, for mature fields, it must be possible to select the zones where new wells are to be drilled, either in order to produce oil by depletion drive or to inject a fluid that maintains the pressure at a sufficient level in the reservoir. The performance of a well at a given point can be assessed using the reservoir model by positioning the well in the desired position and carrying out a flow simulation. The performance of a well can be assessed from the amount of hydrocarbons it produces. Given that the final goal is maximization of the production or of the profitability of the field, it should be possible to test all possible well positions and to select the best one. Such an approach is inappropriate in practice because it involves a high computation time. One alternative is launching an optimization procedure intended to provide the best location possible for a well to optimize the production. However, this approach remains difficult to implement because it requires several thousand iterations.

The concept of production indicator maps, also referred to as quality maps in the literature, has been introduced in order to address in a practical manner the problem of positioning new wells in a reservoir. It is a two-dimensional map comprising a set of cells where each cell is associated with a real value that shows how a new well placed in the cell in question impacts the production or the net present value (NPV) in relation to the base case. The base case corresponds to the initial development scheme which is a scheme for which no new well is added (Da Cruz, P. S., Home, R. N., Deutsch, C., The Quality Map: A Tool for Reservoir Quantification and Decision Making, SPE ATCE, SPE 56578, Houston, Tex., USA, 1999). A production indicator defines an impact on the production of fluid (hydrocarbon) linked with the addition of a well in the cell considered.

To construct this map, a flow simulation can be performed for each cell where a well can be positioned. If the reservoir comprises NX and NY cells along axes X and Y, the total number of cells to be examined is NX×NY minus the number of non-active cells and of cells that already have a well for the base case. This approach requires a significant computation time insofar as NX×NY is large. Besides, the possible cells being considered one after the other, the interferences between the new wells are not taken into account.

In order to reduce the computation times, an interpolation approach has been considered (Cottini-Loureiro, A., Araujo, M., Optimized Well Location by Combination of Multiple Realization Approach and Quality Map Methods, SPE 95413, SPE ATCE, Dallas, Tex., USA, 9-12 Oct., 2005). A simulation is then carried out for some cells within the map and values in the other cells are estimated by interpolation. However, this approach does not account for the interferences between new wells.

The production indicator map quantifies, for each cell, the impact on a production indicator due to the addition of a well in this cell. It accounts for a single well. In order to add several wells and to account for the interferences between these wells, a sequential approach has been suggested. The wells are added one after the other. Each time a well is added, the quality map is updated in the region containing the position selected. A flow simulation is performed for each cell of the region under consideration. (Cheng, Y., McVay, D. A., Lee, W. J., A Practical Approach for Optimization of In fill Well Placement in Tight Gas Reservoirs, Journal of Natural Gas Science and Engineering, 1, 165-176, 2005). This solution requires many simulations and therefore a significant computation time.

Thus, none of the current methods provides a solution yielding precise results within a reduced computation time and accounting for the interferences with the added wells.

SUMMARY OF THE INVENTION

The invention thus is an alternative method for developing a petroleum reservoir from a reservoir model based on the construction of a production indicator map comprising a set of cells for which some production indicators are determined by interpolation. The interpolation method which is selected depends on the distance between the cell being considered and the closest well to the cell being considered. This method also allows updating the production indicator map when wells are added sequentially in the reservoir model, without requiring new simulations. Therefore, with the method of this invention interferences between wells are accounted for and within a limited computation time.

The invention relates to a method of developing an underground reservoir, notably a petroleum reservoir, crossed by at least a first well from which a fluid is produced, wherein a position of at least a second well to be drilled is determined by means of a map comprising a set of cells with each cell being associated with a production indicator as a function of an impact on the fluid production resultant upon addition of a well in this cell. The method comprises constructing the map by the following stages:

a) selecting cells from the set of cells of the map;
b) determining the production indicators in the selected cells;
c) interpolating the production indicators determined in b) on the set of cells of the map by an interpolation accounting for a distance between the cell to be interpolated and the closest well to the cell to be interpolated; and defining the position of the second well by the cell where the production indicator is a maximum.

In an embodiment, the production indicator is an oil volume increment produced by placing a well in the cell or a variation of the net value which is expected.

According to an advantageous embodiment, selection of the cells is achieved by sampling.

Advantageously, the cells are selected by carrying out the following stages:

i. determining reservoir attributes;
ii. constructing a region identification map using an attribute classification method;
iii. selecting the cells as a function of the region identification map.

In an embodiment, the reservoir attributes which are used are selected from among the following attributes: the distance between each cell and the closest well to the cell, dynamic data such as the fluid pressure and the connected fluid volume and seismic data such as the velocities and densities.

According to a preferred embodiment, the classification method is the K-means algorithm.

Preferably, stage c) and the stage of defining the position of the second well are repeated for determination of a position of at least another well, by accounting for the distance between a cell and the closest well to the cell between the first and the second well.

Advantageously, the interpolation model is preferably a second-order polynomial interpolation model or a kriging interpolation model, or a combination of a polynomial interpolation model and of a kriging interpolation model.

The invention also relates to a computer program product downloadable from a communication network and/or recorded on a computer readable medium and/or processor-executable, comprising program code instructions for implementing the method as defined above when the program is executed on a computer.

Furthermore, the invention relates to a method as defined above wherein wells are drilled in the determined positions.

BRIEF DESCRIPTION OF THE DRAWINGS

Other features and advantages of the method according to the invention will be clear from reading the description hereafter of embodiments given by way of non limitative example, with reference to the accompanying figures wherein:

FIG. 3 illustrates several maps. FIGS. 3.1) to 3.4) show the updating of the minimum distance map where FIGS. 3.5) to 3.8) in the middle show updating of the production indicator map; FIGS. 3.9) to 3.12) show the position of the added well (isolated dark position); FIGS. 3.1), 3.5) and 3.9) show the initially existing wells, that is 6 producers. FIGS. 3.2), 3.6) and 3.10) show the previous case to which 1 injector has been added; FIGS. 3.3), 3.7) and 3.11) show the previous case to which a second injector has been added; and FIGS. 3.4), 3.8) and 3.12) show the previous case to which a third injector has been added.

DETAILED DESCRIPTION OF THE INVENTION

The method according to the invention allows efficient development of a petroleum reservoir. The method enables successive selection of zones where it is of interest to place a new well, either a producer or an injector, to improve the reservoir profitability. It is based on the construction of a production indicator map (FIG. 1) accounting for the interferences between wells.

The method according to the invention comprises the following stages:

1) constructing the production indicator map:
   a) selecting cells from the set of cells of said map;
   b) determining production indicators in the selected cells; and
   c) carrying out the following stages to determine the production indicators in all the cells of the map:
      i. defining an interpolation model accounting for the distance between the cell to be interpolated and the closest well, and estimating the parameters of the interpolation model from the production indicators determined in stage b); and
      ii. interpolating the production indicators on all the cells of the map with the interpolation model and of the parameters of stage c)i., and
2) defining the position of the new well by the cell where the production indicator is maximum.

Stage 1) Constructing the Production Indicator Map

Figure 2:
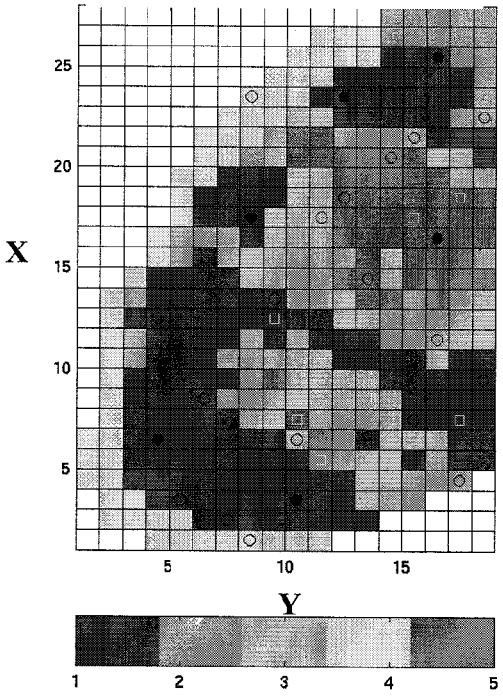
FIG. 2 illustrates a region identification map obtained from an attribute classification.

The production indicator map comprises a set of cells wherein each cell is associated with a production indicator (IP). A production indicator (IP) quantifies an impact on the fluid production due to the addition of a well in this cell. The production indicator (IP) measures a variation of the parameters impacting the fluid production when a well is added in the cell. The production indicator (IP) can be a variation of the total production of all the wells, a variation of net present value expected or a pressure or a flow rate variation. In an embodiment, the production indicator is the increment of the oil volume produced when placing a well, such as an injector well, in this cell.

a) Cell Selection (FIG. 2)

Advantageously, cells of the map to be estimated are selected from a sampling technique that can be entirely computerized, or computerized, then manually complemented, or carried out entirely manually. For example, the sampling technique is a Latin hypercube technique based on a "Maximin" criterion, which allows the space to be divided into equiprobable subspaces sampled in a uniform manner.

According to a preferred embodiment, a region identification map, elaborated beforehand from attributes, is used. The method according to the invention allows efficient development of a petroleum reservoir for which a set of properties (petrophysical or seismic) such as permeability, porosity, saturations, etc., is known. Attributes are understood to be these reservoir properties that can be measured, simulated or calculated which are notably geological data, geometric data, seismic data and dynamic data such as pressure at a time preceding the addition of new wells, the connected fluid volume, the minimum distance to the existing wells, the mean permeability, the porosity, the velocities, the density, etc.

Given that attributes characterizing the reservoir are known, a classification method is applied for analyzing and dividing them into classes. A two-dimensional map, referred to as region identification map and distinguishing regions for which the attributes belong to the same class, is determined therefrom. The cells belonging to the same region are therefore characterized by closely related or similar attributes. Using attributes is advantageous because they involve a negligible computation time.

In a preferred embodiment, classification is achieved with the K-means algorithm, which allows the attributes to be grouped together into K non-overlapping classes. A number of classes (or coefficient K) generally below 10 is selected to obtain a relatively stable result. This algorithm provides the advantage of conceptual simplicity, speed of execution and low memory size requirements.

FIG. 2 shows an example of a map obtained by applying this method. The number of classes are set to five and five regions with different attributes are distinguished. The position of the existing wells is shown by white squares. The cells selected by sampling are represented by a black circle and those added manually by a black point.

Since the region identification map is established, it can guide the cell selection process. It is therefore advantageous to superimpose the cells selected on the region identification map. If a class identified upon creation of the region identification map is considered a priori interesting but comprises few selected cells, additional cells are selected manually. Pertinent selection of the chosen cells, in particular from the region identification map, allows a more precise and more reliable production indicator map to be constructed.

b) Determining the production indicators in the selected cells

For each cell selected in stage a), the production indicator (IP) is determined either through computation or simulation.

Preferably, a simulation of the flow of the fluid contained in the reservoir towards the producing wells is performed for each selected cell, starting from the assumption that a well is added in the selected cell. Therefore, if, in selection stage b), N cells are selected, N flow simulations are carried out with, for each cell, a single well being added in the position under consideration. The simulations give the exact value of the production indicator (IP1, IP2, . . . , IPN) for the selected cells. With the invention, flow measurements, computations or simulations are carried out only for the selected cells. To perform a flow simulation, it is well known to the person skilled in the art to use a software flow simulator, such as Pumaflow® (IFP Energies nouvelles, France).

c) Determining the Production Indicators in All the Cells of the Map i. Defining the Interpolation Model and its Parameters In order to not have to determine the production indicators in all the cells of the map from a computation time consuming process such as a flow simulation, and therefore in order to decrease the computation time, the production indicator is estimated by interpolation on all the non-sampled cells of the map. In order to account for the interferences with the wells, the interpolation model is constructed from a group of regressors comprising an attribute that depends on the distance between the cell to be interpolated and the closest well to the cell to be interpolated. This well can be an existing well or a simulated well.

In an embodiment, a polynomial interpolation model or a kriging interpolation model can be used. For these models, the cells are characterized by the values of the regressors associated therewith which for example may be the spatial coordinates x and y, and the distance between the cell to be interpolated and the closest well to the cell to be interpolated. The latter regressor is introduced to account for the interferences between the added wells. The production indicator in a cell can therefore be expressed by the formula as follows:

$$IP(x, y)=f(x, y, D\min, IP1, IP2, \ldots IPN)$$

with IP being the production indicator in the cell being considered, and IP1, IP2, IPN are the known production indicators (in the selected cells and in the wells).

The interpolation model depends on model construction parameters that must be adjusted to the reservoir being studied. To achieve this adjustment, the values of the production indicators obtained in stage b) are used. In fact, this is possible because, in the selected cells, only these construction parameters are unknown.

ii. Interpolation (FIGS. 3.5) to 3.8))

After the parameters of the interpolation model have been estimated in stage c)i., the production indicators in the cells of the map which were not selected are determined. Estimating the production indicators by interpolation allows not having a supplementary simulator and to reduce the computation times.

FIGS. 3.5) to 3.8) show examples of production indicator maps for one instance. Each case corresponds to a different initial well configuration which is constructed for an increasing number of wells. The production indicator which is selected is the increment of the volume of oil produced. The black zones correspond to areas where the production indicator is a minimum and the dark grey zones correspond to areas where the production indicator is a maximum.

Figure 1:
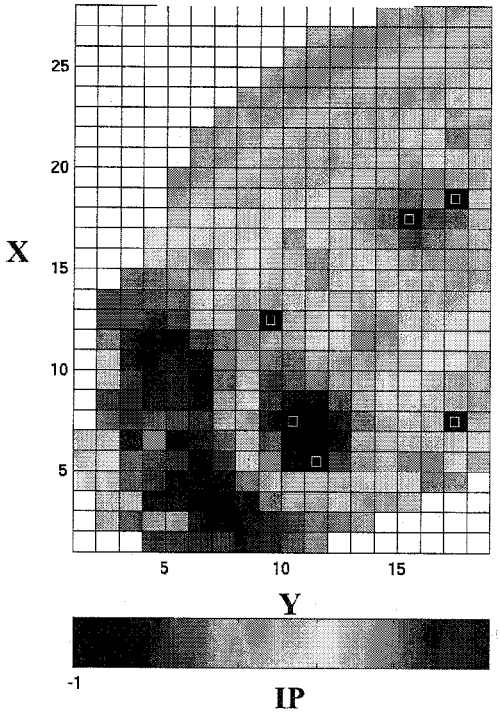
FIG. 1 illustrates a reference production indicator map.

Furthermore, this map can advantageously be updated to integrate the influence of the wells which are successively added without having to launch new flow simulations. FIG. 1 shows an example of a production indicator map. The value in a position corresponds to the production indicator. It is a relative value % of the increment of oil volume produced by placing an injection well in this position. The white squares represent the existing wells.

Stage 2) Positioning a New Well (FIGS. 3.9) to 3.12))

The maximum value of the constructed production indicator thus corresponds to the cell where it will be most advantageous to position a well. A well that is integrated into the group of existing wells is then added to the production scheme. The well can then be drilled subsequently.

FIGS. 3.9) to 3.12) show an example of successive positioning of wells. The added well is represented by the black-coloured cell.

Adding Supplementary Wells

In order to define the optimum location of at least one new well, the minimum distances to the closest well are first updated for each cell of the map. This updating accounts for the well that has just been added. In fact, once a well has been added to the group of existing wells, the distance between each cell and the closest existing or simulated well has to be recalculated. An updated minimum distance map, as shown for an example in FIGS. 3.1) to 3.4), is then obtained. The coordinates of the map cells are modified. The coordinates are x and y and the distance from the cell being considered to the closest existing or simulated well. The current production indicators are thus out of date.

Stage c)ii is then repeated, which leads to update the production indicator map. The values of the production indicators determined in stage b), prior to adding the first well, are kept for the selected cells, except for those for which the distance to the closest well has changed. Accounting for the distance to the closest well in the interpolation process naturally generates a decrease in the production indicators of these cells.

Once the production indicator map updated, stage 2) of defining the position of a new well is repeated.

This procedure is repeated as long as it is desired to add a well.

Thus, the invention treats positions of the new well as parameter that is accounted for in determining the production indicators. Therefore, the interferences between wells are taken into account. Furthermore, stage b) of determining production indicators in the cells which are selected and in stage c) of defining the interpolation model and its parameters are not repeated, which is time saving during the course of the process. This saving of time is significant when the number of sampled cells is large and when stage b) involves a flow simulator for determining the production indicators in the selected cells.

Application Example

To illustrate the method, a test case elaborated within the context of the European project "Production Forecasting with UNcertainty Quantification" from aReal Petroleum Reservoir . The field contains oil and gas. It is producing from six producing wells located close to the oil-gas contact line. The base production scheme covers the period from Jan. 1, 1967 to Jan. 15, 1975. The wells are then closed for three years prior to being produced at an imposed flow rate during the last four years. After eight years, the question whether water injection wells should be added to maintain pressure in the reservoir arises. It is assumed that, from Jan. 15, 1975 to Jan. 15, 1980, production is controlled through the six producer wells and injector wells. The problem is to identify the most strategic positions for the placement of injector wells.

A production indicator (IP) map then has to be constructed using the method according to the invention and the position of the wells to be added has to be deduced therefrom while updating it on an ongoing basis.

The reservoir model is discretized on a grid having 19×28×5 cells with 1761 being active. This configuration leads us to constructing of a production indicator map on a grid having 19×28 cells with 396 being capable of receiving a new well. The base case corresponds to the cumulative oil volume produced by the six producer wells on Jan. 15, 1980 in the absence of any injector well. The production indicator assigned to a cell of the production indicator map corresponds to the extra amount of oil produced when an injector well is placed in the cell considered.

A flow simulation for case PUNQ requires a much reduced computation time. Under such very particular conditions, it is quite possible to perform a flow simulation for all the possible cells which gives access to the exact production indicator (IP) map (FIG. 1).

Several attributes have been determined fort the test case, among which are the pressure and the connected oil volume on Jan. 15, 1975, as well as the connected mean permeability. The K-means algorithm is then applied to identify regions. Five classes are considered for the example being studied. The resulting region identification map is shown in FIG. 2. At this stage, it is difficult to estimate the interest of the regions in terms of performance or profitability. Indications are however provided by the attributes analysis. For example, a zone where the pressure is high is certainly favorable to the placement of a new well. A well is also preferably positioned in a cell where the connected oil volume is great, where permeabilities are high, in a cell sufficiently distant from existing wells, etc. In fact, it is likely that classes 1 and 4 have an interesting potential for drilling new wells, unlike class 5.

Cells are then selected in the map by sampling from a Latin hypercube based on a "Maximin" criterion. By identifying the cells selected in the region identification map (FIG. 2), it is observed that two clusters of class 1, which is predominantly represented and has an a priori high potential according to skilled persons, are not sampled. A skilled person then intervenes manually. The additional positions that are selected are shown by black discs with 5 cells being selected in class 1 and 1 in class 5. A flow simulation is then performed with a flow simulation such as Pumaflow® (IFP Energies nouvelles, France) with an injector well placed in each cell selected, one after the other. The production indicator (IP1, IP2, . . . , IPN) associated with these cells, whose coordinates are the spatial coordinates (X and Y) and the value of the distance (Dmin) from the closest existing well, is deduced therefrom.

The minimum distance (Dmin) to the closest well (existing or simulated) is shown in FIG. 3.1). The production indicators (IP) in the—cells which are not selected are then deduced from a kriging interpolation, whose parameters have been determined beforehand from the flow simulations in the selected cells. FIG. 3.5) shows the resulting production indicator map. It is very close to the reference production indicator map (FIG. 1), although it has been constructed from 26 flow simulations instead of 396. The position of the first well to be added is then defined by the cell where the production indicator (amount of oil produced) is a maximum (FIG. 3.9)) with the latter being integrated into the group of existing wells. To place the next well, the minimum distance map and then the production indicator map are updated. This procedure is repeated as long as it is desired to add wells. FIGS. 3.1) to 3.4) show the evolution of the minimum distance map with the successive addition of wells. FIGS. 3.5) to 3.8) show the resulting evolution of the production indicator map. FIGS. 3.9) to 3.12) show the position selected for the new well from the updated production indicator maps.

The invention claimed is:

1. A method of developing an underground reservoir, crossed by at least a first well from which a fluid is produced, wherein a position of at least a second well to be drilled is determined by a map comprising a set of cells with each cell being associated with a production indicator that is a function of impact on fluid production upon addition of a well in the cell, comprising:

constructing the map by:

a) selecting cells from the set of cells of the map;

b) determining the production indicators in the selected cells including performing a flow simulation for each selected cell for a flow toward the at least first well from which the flued is produced;

c) interpolating the production indicators determined in b) and estimating production indicators of cells which were not selected, the interpolation being on the set of cells of the map by an interpolation model accounting for a distance between a cell to be interpolated and a closest well to the cell to be interpolated and defining a position of the second well adjacent to a cell where the production indicator is a maximum.

2. The method as claimed in claim 1, wherein:

each production indicator is a fluid volume increment produced by placing a well in the cell or a variation of a net expected value.

3. The method as claimed in claim 1, wherein:

selection of the cells is achieved by sampling.

4. The method as claimed in claim 2, wherein:

selection of the cells is achieved by sampling.

5. The method as claimed in claim 1, wherein:

the cells are selected by:

i. determining reservoir attributes;

ii. constructing a region identification map with a classification method using the reservoir attributes; and iii. selecting the cells as a function of the region identification map.

6. The method as claimed in claim 2, wherein:

the cells are selected by:

i. determining reservoir attributes;

ii. constructing a region identification map a classification method using the reservoir attributes ; and iii. selecting the cells as a function of the region identification map.

7. The method as claimed in claim 3, wherein:

the cells are selected by:

i. determining reservoir attributes;

ii. constructing a region identification map with a classification method using the reservoir attributes; and iii. selecting the cells as a function of the region identification map.

8. The method as claimed in claim 4, wherein:

the cells are selected by:

i. determining reservoir attributes;

ii. constructing a region identification map with a classification method using the reservoir attributes; and iii. selecting the cells as a function of the region identification map.

9. The method as claimed in claim 5, wherein:

the reservoir attributes are selected from a distance between each cell and a closest well to each cell, dynamic data including fluid pressure and connected fluid volume and seismic data including velocities and densities.

10. The method as claimed in claim 6, wherein:

the reservoir attributes are selected from a distance between each cell and a closest well to each cell, dynamic data including fluid pressure and connected fluid volume and seismic data including velocities and densities.

11. The method as claimed in claim 7, wherein:

the reservoir attributes are selected from a distance between each cell and a closest well to each cell, dynamic data including fluid pressure and connected fluid volume and seismic data including velocities and densities.

12. The method as claimed in claim 8, wherein:

the reservoir attributes are selected from a distance between each cell and a closest well to each cell, dynamic data including fluid pressure and connected fluid volume and seismic data including velocities and densities.

13. The method as claimed in claim 5, wherein:

the classification method is a K-means algorithm.

14. The method as claimed in claim 9, wherein:

the classification method is a K-means algorithm.

15. The method as claimed in claim 1, wherein steps:

c) and defining a position of a second well are repeated to determine a position of at least another well by accounting for a distance between a cell and a well closest to the cell between the first and the second well.

16. The method as claimed in claim 2, wherein steps:

c) and defining a position of a second well are repeated to determine a position of at least another well by accounting for a distance between a cell and a well closest to the cell between the first and the second well.

17. The method as claimed in claim 3, wherein steps:

c) and defining a position of a second well are repeated to determine a position of at least another well by accounting for a distance between a cell and a well closest to the cell between the first and the second well.

18. The method as claimed in claim 5, wherein steps:

c) and defining a position of a second well are repeated to determine a position of at least another well by accounting for a distance between a cell and a well closest to the cell between the first and the second well.

19. The method as claimed in claim 9, wherein steps:

c) and defining a position of a second well are repeated to determine a position of at least another well by accounting for a distance between a cell and a well closest to the cell between the first and the second well.

20. The method as claimed in claim 13, wherein steps:

c) and defining a position of a second well are repeated to determine a position of at least another well by accounting for a distance between a cell and a well closest to the cell between the first and the second well.

21. The method as claimed in claim 15, wherein steps:

c) and defining a position of a second well are repeated to determine a position of at least another well by accounting for a distance between a cell and a well closest to the cell between the first and the second well.

22. The method as claimed in claim 1, wherein:

the interpolation model is a second-order polynomial interpolation model, a kriging interpolation model, or a combination of a second order polynomial interpolation model and a kriging interpolation model.

23. A computer program product stored on a non-transitory computer readable medium downloadable from at least one of a communication network, a computer readable medium and a processor, comprising program code instructions which when executed on a computer or processor implement a method of developing an underground reservoir, crossed by at least a first well from which a fluid is produced, wherein a position of at least a second well to be drilled is determined by a map comprising a set of cells with each cell being associated with a production indicator that is a function of impact on fluid production upon addition of a well in the cell, the method of developing comprising constructing the map by:

a) selecting cells from the set of cells of the map;

b) determining the production indicators in the selected cells including performing a flow simulation for each selected cell for a flow toward the at least first well from which the flued is produced;

c) interpolating the production indicators determined in b) and estimating production indicators of cells which were not selected, the interpolation being on the set of cells of the map by an interpolation model accounting for a distance between a cell to be interpolated and a closest well to the cell to be interpolated and defining a position of the second well adjacent to a cell where the production indicator is a maximum.

* * * * *